US011399230B2

(12) United States Patent
Tsuchihashi et al.

(10) Patent No.: US 11,399,230 B2
(45) Date of Patent: Jul. 26, 2022

(54) ELECTROACOUSTIC TRANSDUCER

(71) Applicant: Yamaha Corporation, Hamamatsu (JP)

(72) Inventors: Yu Tsuchihashi, Hamamatsu (JP); Tomoya Miyata, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 17/333,741

(22) Filed: May 28, 2021

(65) Prior Publication Data

US 2021/0289287 A1 Sep. 16, 2021

Related U.S. Application Data

(63) Continuation of application No. PCT/JP2019/044724, filed on Nov. 14, 2019.

(30) Foreign Application Priority Data

Nov. 29, 2018 (JP) ..... JP2018-223178

(51) Int. Cl.
*H04R 1/28* (2006.01)
*H04R 1/10* (2006.01)

(52) U.S. Cl.
CPC ..... *H04R 1/28* (2013.01); *H04R 1/10* (2013.01)

(58) Field of Classification Search
CPC ..... H04R 1/28
See application file for complete search history.

(56) References Cited

U.S. PATENT DOCUMENTS

2020/0366984 A1* 11/2020 Chen ..... H04R 17/00
2021/0289288 A1* 9/2021 Tsuchihashi ..... H04R 1/2884

FOREIGN PATENT DOCUMENTS

JP 2018-7220 A 1/2018

OTHER PUBLICATIONS

International Search Report (PCT/ISA/210) issued in PCT Application No. PCT/JP2019/044724 dated Jan. 28, 2020 with English translation (five (5) pages).
International Preliminary Report on Patentability (PCT/IB/338 & PCT/IB/373) issued in PCT Application No. PCT/JP2019/044724, dated Jun. 10, 2021, including Japanese-language Written Opinion (PCT/ISA/237) with English translation (nine (9) pages).

* cited by examiner

*Primary Examiner* — Andrew L Sniezek
(74) *Attorney, Agent, or Firm* — Crowell & Moring LLP

(57) ABSTRACT

A electroacoustic transducer includes a housing, a piezoelectric element, a partition wall, a first tube, and a second tube. The piezoelectric element is disposed in the housing and includes a porous film and a pair of electrodes that sandwich the porous film therebetween. The partition wall divides an inner space of the housing into a first space closer to one of the pair of electrodes, and a second space closer to another of the pair of electrodes. The first tube establishes communication between a sound wave emission opening that is open to an outer space of the housing and the first space. The second tube establishes communication between the sound wave emission opening and the second space.

14 Claims, 7 Drawing Sheets

ELECTROACOUSTIC TRANSDUCER

CROSS REFERENCE TO RELATED APPLICATION

The present application is a continuation application of International Application No. PCT/JP2019/044724, filed on Nov. 14, 2019, which claims priority to Japanese Patent Application No. 2018-223178, which was filed on Nov. 29, 2018. The contents of these applications are incorporated by reference in their entirety.

BACKGROUND

The following disclosure relates to an electroacoustic transducer such as a speaker, an earphone, and headphones.

An electroacoustic transducer includes a diaphragm that vibrates in accordance with an externally applied sound signal (an electric signal representing a sound waveform) to output a sound wave based on the sound signal. For instance, there is an earphone that includes an electromagnetic tweeter including a piezoelectric element as the diaphragm and a dynamic woofer. In the earphone, sounds output from the tweeter and sounds output from the woofer are output from the same sound emitting portion.

SUMMARY

There has been proposed using, as the diaphragm for the speaker, a piezoelectric element that includes a porous film and a pair of electrodes sandwiching the porous film. In such a piezoelectric element, the porous film expands or contracts in its thickness direction in accordance with a voltage applied between the electrodes, so that the piezoelectric element vibrates. In the speaker including the piezoelectric element, sound waves are emitted from both surfaces of the diaphragm depending on how the diaphragm is disposed. The conventional speakers, however, utilize only the sound wave emitted from one surface of the diaphragm.

Accordingly, one aspect of the present disclosure is directed to a technique of enabling effective utilization of sound waves respectively emitted from opposite surfaces of a diaphragm in an electroacoustic transducer in which a piezoelectric element is used as the diaphragm.

In one aspect of the present disclosure, an electroacoustic transducer includes: a housing; a piezoelectric element disposed in the housing and including a porous film and a pair of electrodes sandwiching the porous film therebetween; a partition wall dividing an inner space of the housing into a first space closer to one of the pair of electrodes and a second space closer to the other of the pair of electrodes; a first tube that establishes communication between a sound wave emission opening that is open to an outer space of the housing and the first space; and a second tube that establishes communication between the sound wave emission opening and the second space.

Other objects, features, advantages, as well as the technical and industrial significance of the present disclosure will be better understood by reading the following detailed description of embodiments, when considered in connection with the accompanying drawings, in which:

DETAILED DESCRIPTION

Figure 1:
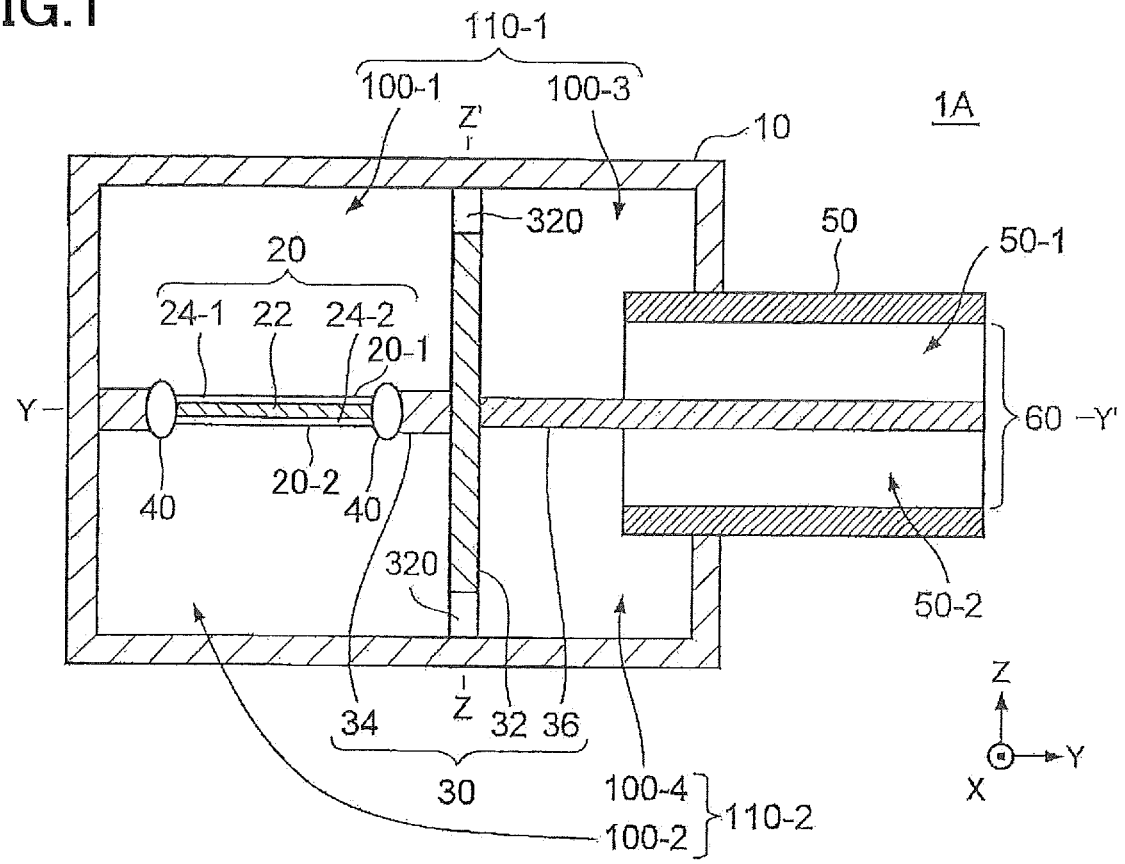
FIG. 1 is a cross-sectional view of an inventive earphone.
Figure 2:
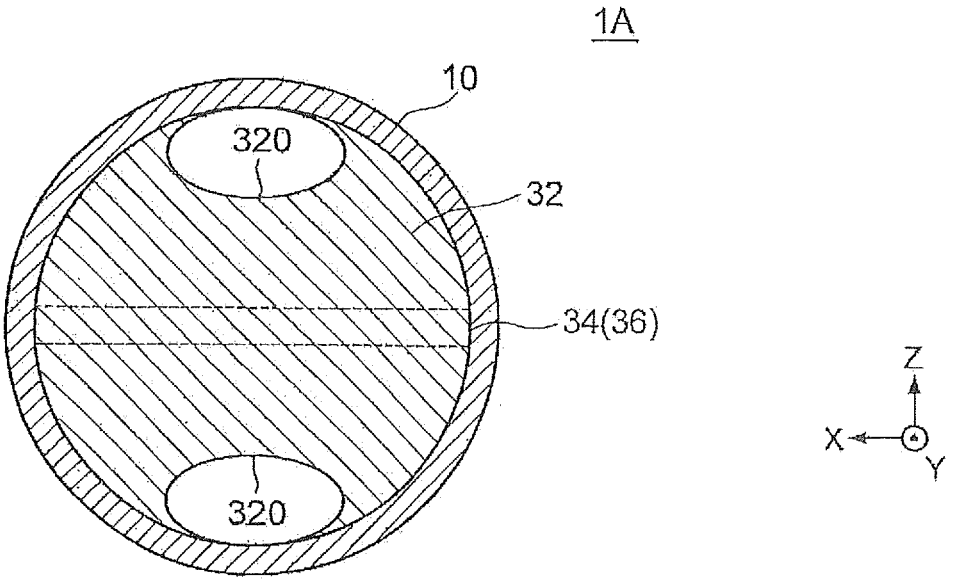
FIG. 2 is a cross-sectional view of the earphone of FIG. 1.
Figure 3:
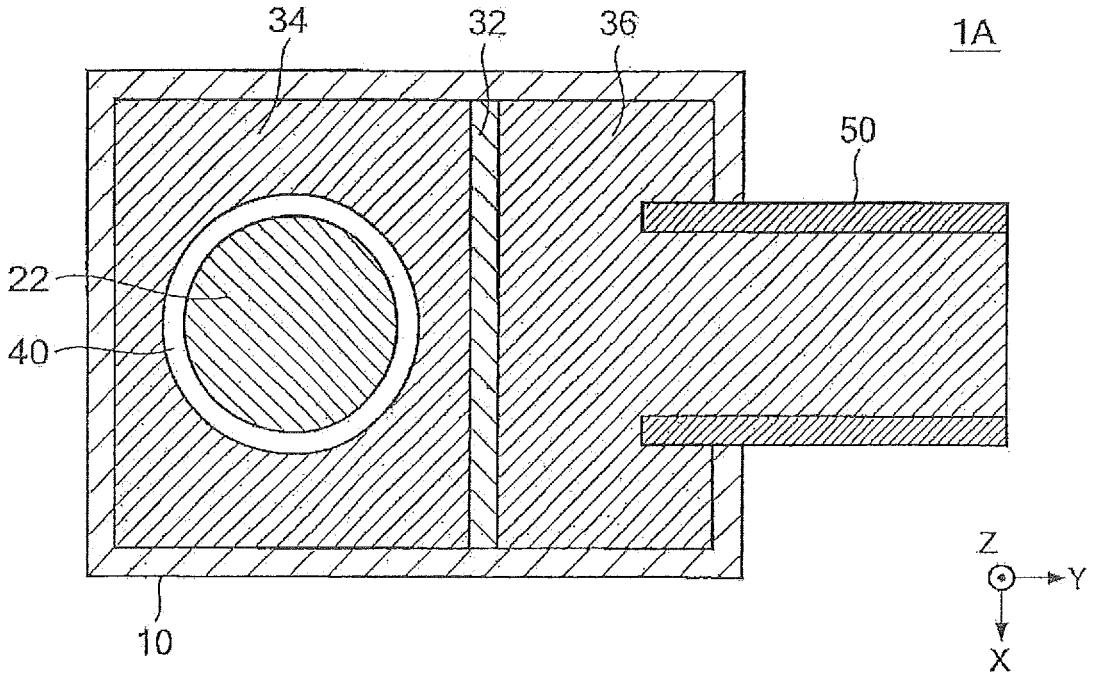
FIG. 3 is a cross-sectional view of the earphone of FIG. 1.

Referring to the drawings, there will be hereinafter described embodiments of the present disclosure. FIGS. 1-3 are cross-sectional views of an earphone 1A, as one example of an electroacoustic transducer, according to an embodiment of the present disclosure. FIG. 2 is a cross-sectional view taken along a plane along line Z-Z' in FIG. 1. FIG. 3 is a cross-sectional view taken along a plane along line Y-Y' in FIG. 1. As illustrated in FIGS. 1-3, the earphone 1A includes a housing 10, a diaphragm 20, a partition wall 30, and a tube 50.

The housing 10 is a hollow cylindrical member formed of resin. A through-hole, to which the tube 50 is mounted, is formed in one of two circular end faces of the housing 10. The tube 50 connects the housing 10 and an earpiece to be inserted into an earhole of a user. Like the housing 10, the tube 50 is formed of resin. In FIG. 1 and other drawings, illustration of the earpiece is omitted.

The diaphragm 20 is a piezoelectric element that vibrates in accordance with an externally applied sound signal. As illustrated in FIGS. 1 and 3, the diaphragm 20 is shaped like a flat disk having a diameter smaller than an inside diameter of the housing 10. As illustrated in FIG. 1, the diaphragm 20 includes a porous film 22 and a pair of electrodes 24-1, 24-2 sandwiching the porous film 22 therebetween. In the following description, a direction from one of the two electrodes 24-1, 24-2 toward the other of the two electrodes 24-1, 24-2 will be referred to as a thickness direction of the porous film 22. In FIGS. 1-3, a Z direction corresponds to the thickness direction of the porous film 22. The diaphragm 20 may have any planar shape, namely, may have any shape viewed in the Z direction, other than a circle. That is, the planar shape of the diaphragm 20 may be an ellipse or a polygon such as a quadrangle or a pentagon.

The porous film 22 is formed of a piezoelectric material. One of the electrodes 24-1, 24-2 is grounded. To the other of the electrodes 24-1, 24-2, a voltage based on the sound signal is applied. The porous film 22 expands or contracts in the thickness direction based on the voltage applied between the electrodes 24-1, 24-2. Specifically, based on the voltage applied between the electrodes 24-1, 24-2, a portion of the porous film 22 sandwiched between the electrodes 24-1, 24-2 expands in mutually opposite directions from the center of the porous film 22 in the thickness direction toward the respective electrodes 24-1, 24-2 or contracts in mutually opposite directions from the respective electrodes 24-1, 24-2 toward the center in the thickness direction. With this configuration, the diaphragm 20 vibrates, and sound waves are emitted to spaces located outside the respective electrodes 24-1, 24-2.

The piezoelectric material of which the porous film 22 is formed has piezoelectric characteristics given as follows. For instance, a multiplicity of flat pores are formed in polytetrafluoroethylene (PTFE), polypropylene (PP), polyethylene(PE), polyethylene terephthalate (PET) or the like, and opposed faces of the flat pores are polarized and electrified by a corona discharge or the like. A lower limit of an average thickness of the porous film 22 is preferably 10 μm and more preferably 50 μm. An upper limit of the average thickness of the porous film 22 is preferably 500 μm and more preferably 200 μm. When the average thickness of the porous film 22 is less than the lower limit, the strength of the porous film 22 may be insufficient. When the average thickness of the porous film 22 is greater than the upper limit, the deformation amount of the porous film 22 may decrease, resulting in an insufficient output sound pressure.

The electrodes 24-1, 24-2 are laminated respectively on opposite surfaces of the porous film 22. When it is not necessary to distinguish the electrode 24-1 and the electrode 24-2 from each other, each of them will be referred to as "electrode 24". The electrode 24 may be formed of any conductive material examples of which include: metals such as aluminum, copper, and nickel: and a carbon. An average thickness of the electrode 24, which may vary depending on a laminating process, is not smaller than 0.1 μm and not greater than 30 μm, for instance. When the average thickness of the electrode 24 is less than the lower limit, the strength of the electrode 24 may be insufficient. When the average thickness of the electrode 24 is greater than the upper limit, the vibration of the porous film 22 may be inhibited. The electrodes 24 may be laminated on the porous film 22 by any suitable method such as vapor deposition of a metal, printing with a conductive carbon ink, and application and drying of a silver paste.

As illustrated in FIG. 1, the partition wall 30 includes a first member 32, a second member 34, and a third member 36. As illustrated in FIG. 2, the first member 32 is shaped like a flat disk whose diameter is equal to the inside diameter of the housing 10. As illustrated in FIG. 3, the second member 34 is shaped like a rectangular plate whose length in an X direction is equal to the inside diameter of the housing 10. The third member 36 is shaped like a plate having a planar shape illustrated in FIG. 3. Like the housing 10, the first member 32, the second member 34, and the third member 36 are formed of resin.

As illustrated in FIG. 2, the first member 32 has two elliptical cutouts 320 formed at its diametrically opposite ends. As illustrated in FIGS. 1-3, the second member 34 is bonded by an adhesive or the like to one of two generally circular surfaces of the first member 32 at a middle position thereof in a direction from one of the two cutouts 320 toward the other of the two cutouts 320, i.e., in the Z direction, such that the second member 34 extends so as to be orthogonal to the Z direction. The third member 36 is bonded by an adhesive or the like to the other of the two generally circular surfaces of the first member 32 at a middle position thereof in the Z direction, such that the third member 36 extends so as to be orthogonal to the Z direction. In the present embodiment, the partition wall 30 is constituted by the three separate members, i.e., the first member 32, the second member 34, and the third member 36. The partition wall 30 may be formed by integral molding of all of or a part of these three members.

The second member 34 has a through-hole to which the diaphragm 20 is mounted. As illustrated in FIGS. 1 and 3, the diaphragm 20 is mounted to the through-hole of the second member 34 via a ring-like elastic member 40. The diaphragm 20 is mounted to the through-hole of the second member 34 via the elastic member 40 for preventing the vibration of the diaphragm 20 in the thickness direction from being inhibited. As illustrated in FIGS. 1 and 3, the diaphragm 20 is disposed in the housing 10 in a state in which the diaphragm 20 is attached to the partition wall 30, more strictly, in a state in which the diaphragm 20 is attached to the second member 34 of the partition wall 30. As illustrated in FIG. 1, the diaphragm 20 is disposed such that the diaphragm 20 and the second member 34 of the partition wall 30 are arranged in a row in a Y direction. Thus, it is noted that the diaphragm 20 is disposed on the same plane as the second member 34 of the partition wall 30.

An inner space of the housing 10 (a space of the housing 10 closer to the diaphragm 20) is divided into four spaces 100-1, 100-2, 100-3, 100-4 by the partition wall 30 to which the diaphragm 20 is attached. The space 100-2 and the space 100-4 are in communication with each other through the one of the two cutouts 320. In the following description, a space provided by the spaces 100-1, 100-3 that are in communication with each other through the other of the two cutouts 320 will be referred to as a first space 110-1, and a space provided by the spaces 100-2, 100-4 that are in communication with each other through the one of the two cutouts 320 will be referred to as a second space 110-2. In the present embodiment, the first space 110-1 and the second space 110-2 are substantially identical in shape and volume. That is, as illustrated in FIG. 1, the partition wall 30 divides the inner space of the housing 10 into the first space 110-1 closer to one of the two electrodes of the diaphragm 20, i.e., the electrode 24-1, and the second space 110-2 closer to the other of the two electrodes, i.e., the electrode 24-2. As illustrated in FIG. 1, the diaphragm 20 is attached to the second member 34 of the partition wall 30 via the elastic member 40. Accordingly, the diaphragm 20 divides, as a part of the partition wall 30, the inner space of the housing 10 into the first space 110-1 and the second space 110-2.

When one of opposite surfaces of the diaphragm 20 that is located on a side of the electrode 24-1 is referred to as a first surface 20-1 and the other of the opposite surfaces of the diaphragm 20 that is located on a side of the electrode 24-2 is referred to as a second surface 20-2 as illustrated in FIG. 1, the first surface 20-1 is exposed to the first space 110-1 without being exposed to the second space 110-2, and the second surface 20-2 is exposed to the second space 110-2 without being exposed to the first space 110-1.

As illustrated in FIG. 1, the tube 50 is divided, by the third member 36 of the partition wall 30, into two tubes, i.e., a first tube 50-1 and a second tube 50-2, that have substantially the same tube length and substantially the same cross-sectional area. The first tube 50-1 establishes communication between a sound wave emission opening 60 that is open to an outer space of the housing 10 and the first space 110-1. The second tube 50-2 establishes communication between the sound wave emission opening 60 and the second space 110-2.

In the earphone 1A of the present embodiment, one of the two electrodes 24-1, 24-2 is grounded. When a voltage based on the sound signal is applied to the other of the two electrodes 24-1, 24-2, the diaphragm 20 vibrates and sound waves in the same phase based on the sound signal are emitted respectively from the first surface 20-1 located on the side of the electrode 24-1 and the second surface 20-2 located on the side of the electrode 24-2. The sound wave emitted from the first surface 20-1 of the diaphragm 20 located on the side of the electrode 24-1 is emitted through the sound wave emission opening 60 to the outer space of the housing 10 via the first space 110-1 and the first tube 50-1. The sound wave emitted from the second surface 20-2 of the diaphragm 20 located on the side of the electrode 24-2 is emitted through the sound wave emission opening 60 to the outer space of the housing 10 via the second space 110-2 and the second tube 50-2.

The sound waves respectively emitted from the first surface 20-1 of the diaphragm 20 located on the side of the electrode 24-1 and the second surface 20-2 of the diaphragm 20 located on the side of the electrode 24-2 are in the same phase, and acoustic spaces to which the respective sound waves propagate have substantially the same shape. Thus, frequency characteristics of sounds that are emitted from one of the opposite surfaces of the diaphragm 20 to reach the ear of the user are identical to frequency characteristics of sounds that are emitted from the other of the opposite surfaces of the diaphragm 20 to reach the ear of the user. For instance, if the frequency characteristics of the former are flat frequency characteristics not including peaks and dips, the frequency characteristics of the latter are also flat. In the earphone 1A of the present embodiment, the sounds emitted from both surfaces of the diaphragm 20 are superposed on one another at the sound wave emission opening 60, so that the earphone 1A of the present embodiment can obtain characteristics in which the output (sound volume) is doubled, as compared with conventional earphones that utilize only sounds emitted from its one surface.

As explained above, the earphone 1A of the present embodiment effectively utilize the sound waves respectively emitted from both surfaces of the diaphragm 20 so as to attain doubled output, as compared with the conventional earphones that utilize only the sounds emitted from its one surface.

Figure 4:
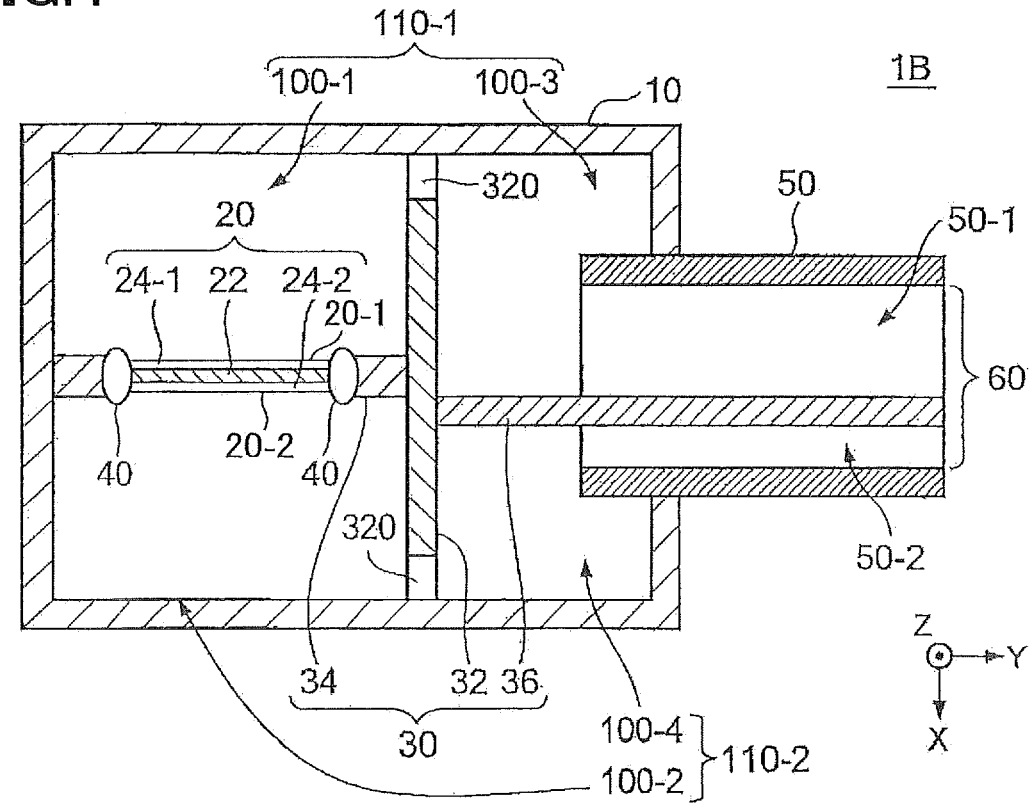
FIG. 4 is a cross-sectional view of an inventive earphone.
Figure 5:
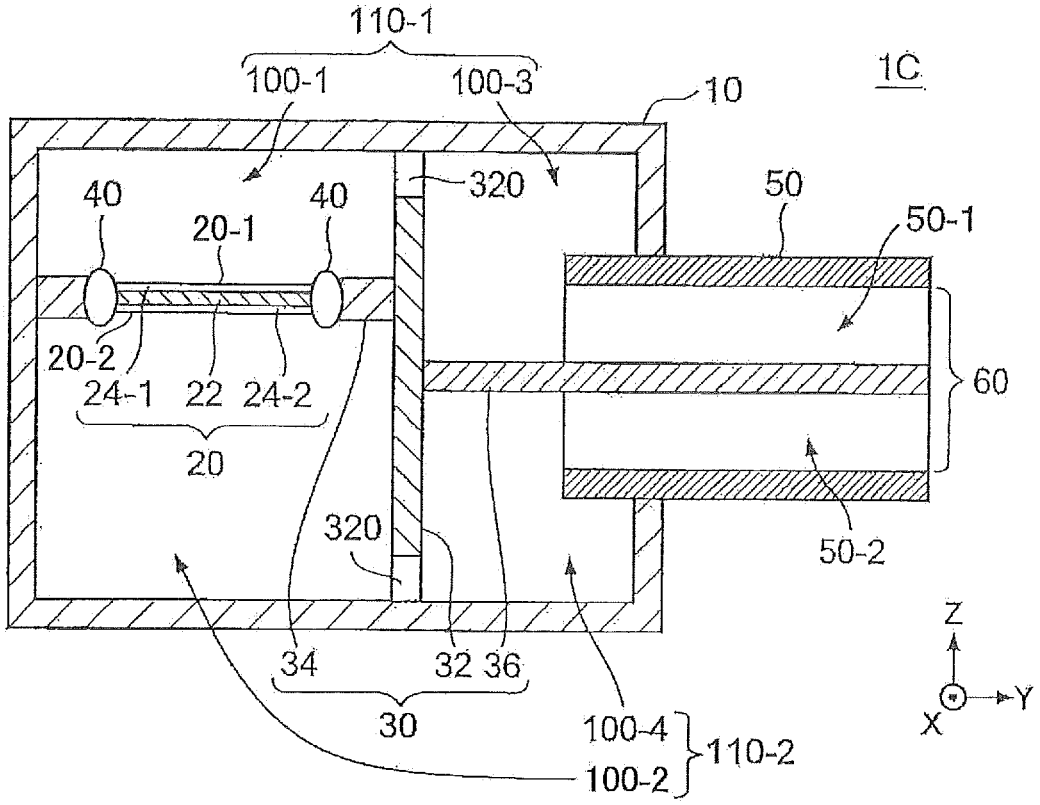
FIG. 5 is a cross-sectional view of an inventive earphone.

FIGS. 4 and 5 are cross-sectional views respectively illustrating an earphone 1B and an earphone 1C according to an embodiment of the present disclosure. The same reference signs as used in FIG. 1 are used to identify the corresponding constituent elements in FIGS. 4 and 5. In each of the earphones 1B, 1C of the present embodiment, two acoustic spaces, to which the sound waves respectively emitted from one and the other of the opposite surfaces of the diaphragm 20 propagate, are different in shape. The earphone 1B of the present embodiment differs from the earphone 1A of the previous embodiment in this aspect.

In the earphone 1B illustrated in FIG. 4, the third member 36 is disposed so as to be shifted in the Z direction such that the cross-sectional area of the second tube 50-2 is smaller than the cross-sectional area of the first tube 50-1. In the earphone 1C illustrated in FIG. 5, the cross-sectional area of the first tube 50-1 and the cross-sectional area of the second tube 50-2 are equal to each other. In the earphone 1C, however, the second member 34 is disposed so as to be shifted in the Z direction such that the volume of the space 100-1 is smaller than the volume of the space 100-2, in other words, such that the volume of the first space 110-1 is smaller than the volume of the second space 110-2. The two acoustic spaces, to which the sound waves respectively emitted from one and the other of the opposite surfaces of the diaphragm 20 propagate, have mutually different shapes for the following reasons.

Some adjustment such as emphasis of high- and low-frequency ranges is often needed in the earphone depending on the sound signal based on which sounds are to be reproduced, tastes or preferences of the user, etc. In the configuration illustrated in FIG. 4, reflection of sounds in the high-frequency range is small in the first tube 50-1 whose cross-sectional area is enlarged, thus enabling emission of sounds in which characteristics of the high-frequency range are emphasized. In the second tube 50-2 whose cross-sectional area is reduced, on the other hand, reflection of sounds in the high-frequency range is strong, and sounds in the low-frequency range are relatively allowed to pass. As a result, sounds in the mid-frequency range are relatively lowered at the sound wave emission opening 60 of the earphone 1B, as compared with the earphone 1A of the previous embodiment, thus achieving characteristics in which the low-frequency range and the high-frequency range are emphasized. It is noted that the cross-sectional area of one of the first tube 50-1 and the second tube 50-2 may remain the same as the cross-sectional area thereof in the previous embodiment while the cross-sectional area of the other of the first tube 50-1 and the second tube 50-2 may be changed, whereby only the low-frequency range or only the high-frequency range may be emphasized.

In the earphone 1B illustrated in FIG. 4, the high-frequency range and the low-frequency range are emphasized by adjusting the cross-sectional area of the first tube 50-1 and the cross-sectional area of the second tube 50-2. In the earphone 1C illustrated in FIG. 5, the volume of the first space 110-1 and the volume of the second space 110-2 are adjusted to adjust the sound quality similarly. The reasons are as follows.

In the earphone 1A of the previous embodiment, there is generated Helmholtz resonance (hereinafter referred to as "first Helmholtz resonance") in which the first space 110-1 serves as a cavity and the first tube 50-1 serves as a neck, and there is generated Helmholtz resonance (hereinafter referred to as "second Helmholtz resonance") in which the second space 110-2 serves as a cavity and the second tube 50-2 serves as a neck. As described above, in the earphone 1A of the previous embodiment, the volume of the first space 110-1 and the volume of the second space 110-2 are substantially equal to each other, and the cross-sectional area of the first tube 50-1 and the cross-sectional area of the second tube 50-2 are substantially equal to each other. Thus, the resonance frequency of the first Helmholtz resonance and the resonance frequency of the second Helmholtz resonance in the earphone 1A of the previous embodiment are substantially equal to each other. When the volume of each of the first space 110-1 and the second space 110-2 is represented as V and the cross-sectional area of each of the first tube 50-1 and the second tube 50-2 is represented as S, the resonance frequency $f_0$ of the first Helmholtz resonance and the second Helmholtz resonance is represented by the following expression (1). In the expression (1), l represents a length of the neck, c represents a sound speed, and δ represents an open end correction value. When the diameter of the opening of the neck is d, δ is approximately equal to 0.8×d, i.e., δ≅0.8×d.

$$f_0 = \frac{c}{2\pi}\sqrt{\frac{s}{V(l+\delta)}} \tag{1}$$

Also in the earphone 1C of FIG. 5, the first Helmholtz resonance and the second Helmholtz resonance are generated. In the earphone 1C, the position at which the second member 34 is disposed is shifted upward in the Z direction with respect to the middle position of the first member 32 in the Z direction, so that the volume of the first space 110-1 is smaller than that of the second space 110-2. As a result, the volume of the first space 110-1 in the earphone 1C of FIG. 5 is smaller than the volume of the first space 110-1 in the earphone 1A of FIG. 1. Thus, the resonance frequency of the first Helmholtz resonance in the earphone 1C is shifted to a higher frequency side than the resonance frequency $f_0$ in the previous embodiment. In the earphone 1C of FIG. 5, the volume of the second space 110-2 is larger than the volume of the second space 110-2 in the earphone 1A. Thus, the resonance frequency of the second Helmholtz resonance in the earphone 1C is shifted to a lower frequency side than the resonance frequency $f_0$ in the previous embodiment. Like the earphone 1B, the earphone 1C of FIG. 5 also achieves the characteristics in which the low-frequency range and the high-frequency range are emphasized.

As explained above, the present embodiment enables the sound-quality adjustment in specific frequency ranges while effectively utilizing the sound waves emitted from both surfaces of the diaphragm 20.

In addition, the earphones according to the present embodiment enjoy constant acoustic characteristics over a wide frequency range from low frequencies to high frequencies. Conventional earphones sometimes include driver units of different types provided for different frequency ranges. In this case, the vibration characteristics unique to the respective driver units are different among the driver units, causing unnaturalness in the crossover frequency range. For instance, in a case where the driver unit for the low-frequency range and the driver unit for the high-frequency range are different in material, sound reverberation in the low-frequency range and sound reverberation in the high-frequency range may not match with each other. In contrast, the earphones according to the present embodiment do not include driver units of different types used for different frequency ranges, thus achieving constant acoustic characteristics over a wide frequency range from low frequencies to high frequencies. Further, because the earphones according to the present embodiment do not include driver units of different types used for different frequency ranges, resulting in cost and size reductions.

Figure 6:
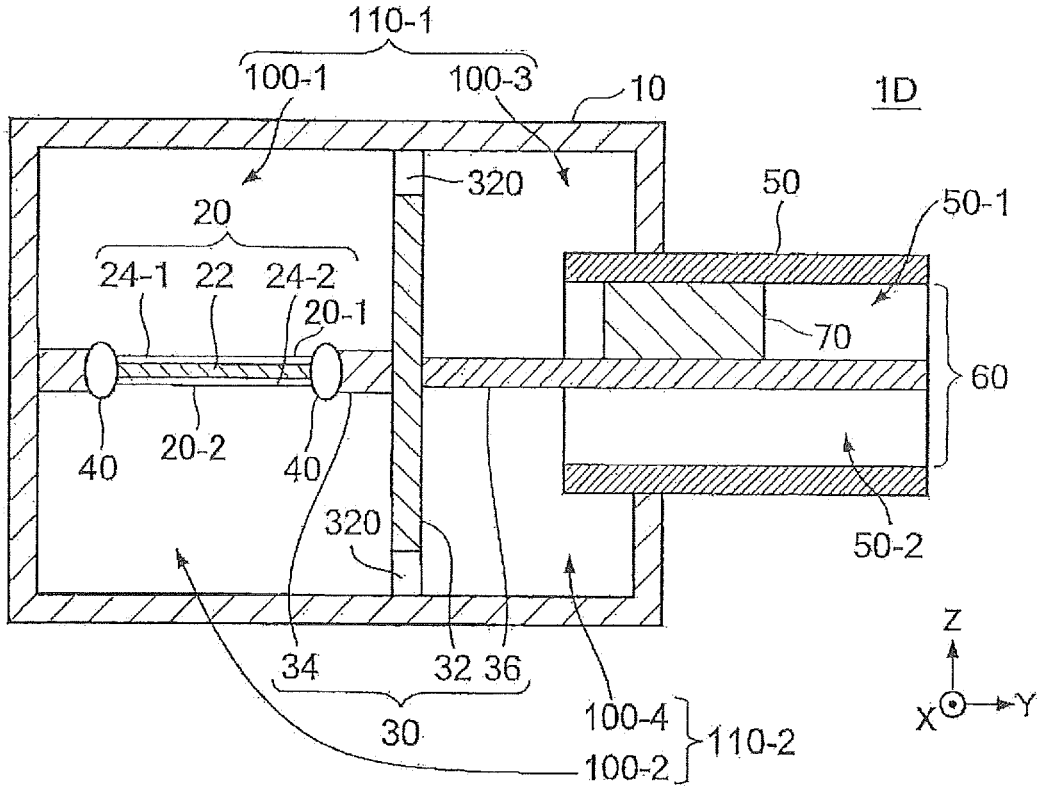
FIG. 6 is a cross-sectional view of an inventive earphone.
Figure 7:
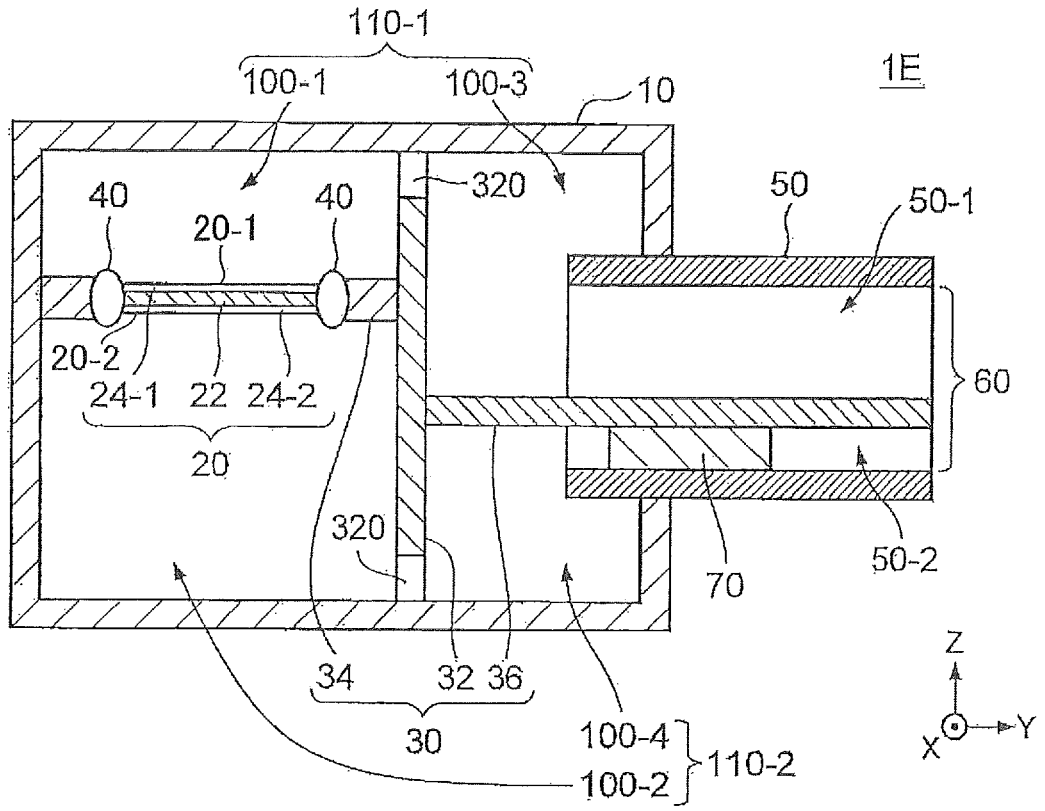
FIG. 7 is a cross-sectional view of an inventive earphone.

FIGS. 6 and 7 are cross-sectional views respectively illustrating an earphone 1D and an earphone 1E according to an embodiment of the present disclosure. The same reference signs as used in FIG. 1 are used to identify the corresponding constituent elements in FIGS. 6 and 7. As apparent from a comparison between FIG. 1 and FIG. 6, the earphone 1D illustrated in FIG. 6 differs from the earphone 1A of the previous embodiment in that a sound absorber 70 formed of a nonwoven fabric or the like is packed in the first tube 50-1. Further, as apparent from a comparison between FIG. 7 and FIG. 5, the earphone 1E illustrated in FIG. 7 differs from the earphone 1C of the previous embodiment in that i) the cross-sectional area of the second tube 50-2 is smaller than the cross-sectional area of the first tube 50-1 and ii) the sound absorber 70 is packed in the second tube 50-2.

Packing the sound absorber in the tube 50 is equivalent to reducing the cross-sectional area of the tube 50. According to the present embodiment, the fine adjustment of the sound-quality in specific frequency ranges can be easily performed by packing the sound absorber in any one of the first tube 50-1 and the second tube 50-2. Also in the present embodiment, the sound waves emitted from both surfaces of the diaphragm 20 can be effectively utilized as in the previous embodiment. Further, the earphones of the present embodiment do not include driver units of different types used for different frequency ranges, thus achieving constant acoustic characteristics over a wide frequency range from low frequencies to high frequencies and resulting in cost and size reductions, as in the previous embodiment. In the present embodiment, the sound absorber 70 is packed in one of the first tube 50-1 and the second tube 50-2. The sound absorber 70 may be packed in both the first tube 50-1 and the second tube 50-2.

FIGS. 8-11 are cross-sectional views respectively illustrating an earphone 1F, an earphone 1G, an earphone 1H, and an earphone 1I according to an embodiment of the present disclosure. The earphone 1F illustrated in FIG. 8 differs from the earphone 1A of the previous embodiment in the following three aspects. The first different aspect is that the earphone 1F includes a partition wall 30' in place of the partition wall 30. As apparent from a comparison between FIG. 8 and FIG. 5, the partition wall 30' differs from the partition wall 30 in that i) the partition wall 30' does not have the through-hole to which the diaphragm 20 is mounted and ii) the partition wall 30' has a generally L-shaped cross section. In the earphone 1F of the present embodiment, the inner space of the housing 10 is divided by the partition wall 30' into the space 100-1 and the space 100-2 whose volume is smaller than that of the space 100-1.

Figure 8:
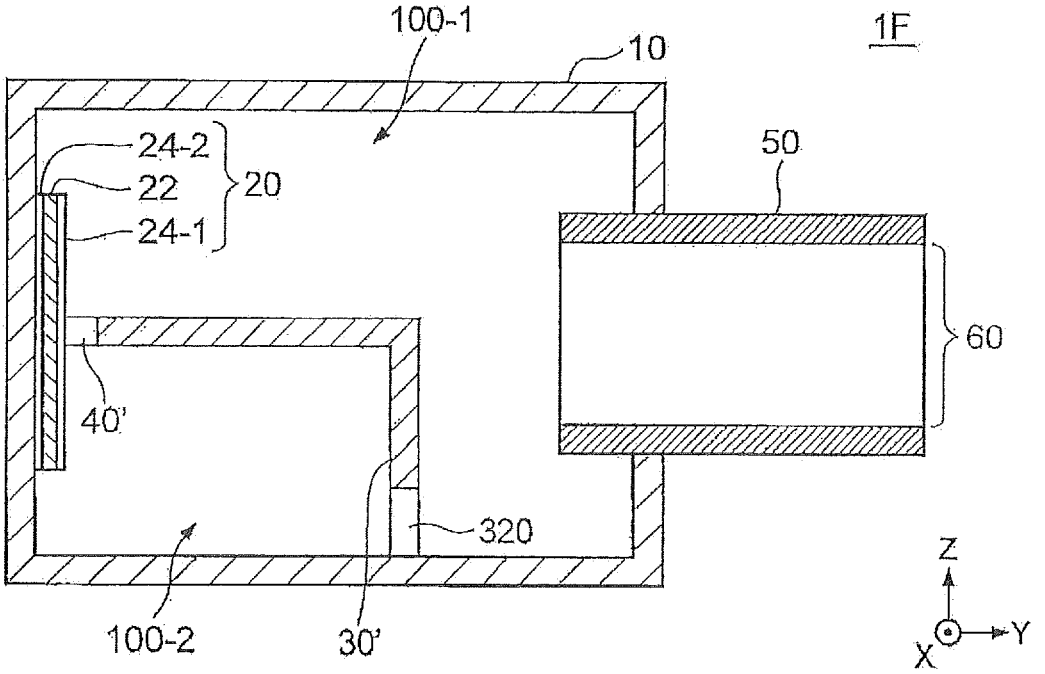
FIG. 8 is a cross-sectional view of an inventive earphone.

The second different aspect is that the diaphragm 20 is disposed such that one surface of the diaphragm 20, namely, one surface thereof located on the side of the electrode 24-1, faces the space 100-1 and the space 100-2. An elastic member 40' in FIG. 8 is a member filling a gap between the diaphragm 20 and one end of the partition wall 30' without inhibiting the vibration of the diaphragm 20 in the thickness direction. The third different aspect is that the tube 50 is not divided into the first tube 50-1 and the second tube 50-2. The tube 50 establishes communication between the space 100-1 and the sound wave emission opening 60 and communication between the space 100-2 and the sound wave emission opening 60.

In the earphone 1F constructed as illustrated in FIG. 8, reflection of sounds in the high-frequency range is small in the space 100-1, thus enabling emission of sounds in which characteristics of the high-frequency range are emphasized. In the space 100-2, on the other hand, reflection of sounds in the high-frequency range is strong, and sounds in the low-frequency range are relatively allowed to pass. As a result, sounds in the mid-frequency range are relatively lowered at the sound wave emission opening 60 at which sounds in the low-frequency range and sounds in the high-frequency range are superposed, as compared with the earphone 1A of the previous embodiment, thus achieving the characteristics in which the low-frequency range and the high-frequency range are emphasized.

Helmholtz resonance is generated also in the earphone 1F of the present embodiment. In the earphone 1F, the first Helmholtz resonance is generated in which the space 100-1 serves as a cavity and the tube 50 serves as a neck, and the second Helmholtz resonance is generated in which the space 100-2 serves as a cavity and the tube 50 serves as a neck. As described above, in the earphone 1F, the volume of the space 100-1 is larger than the volume of the space 100-2, and the resonance frequency of the first Helmholtz resonance is lower than the resonance frequency of the second Helmholtz resonance. Thus, like the earphone 1C of the previous embodiment, the earphone 1F of the present embodiment enables the sound-quality adjustment in specific frequency ranges. In addition, the earphone 1F of the present embodiment does not include driver units of different types used for different frequency ranges, thus achieving constant acoustic characteristics over a wide frequency range from low frequencies to high frequencies and resulting in cost and size reductions.

Figure 9:
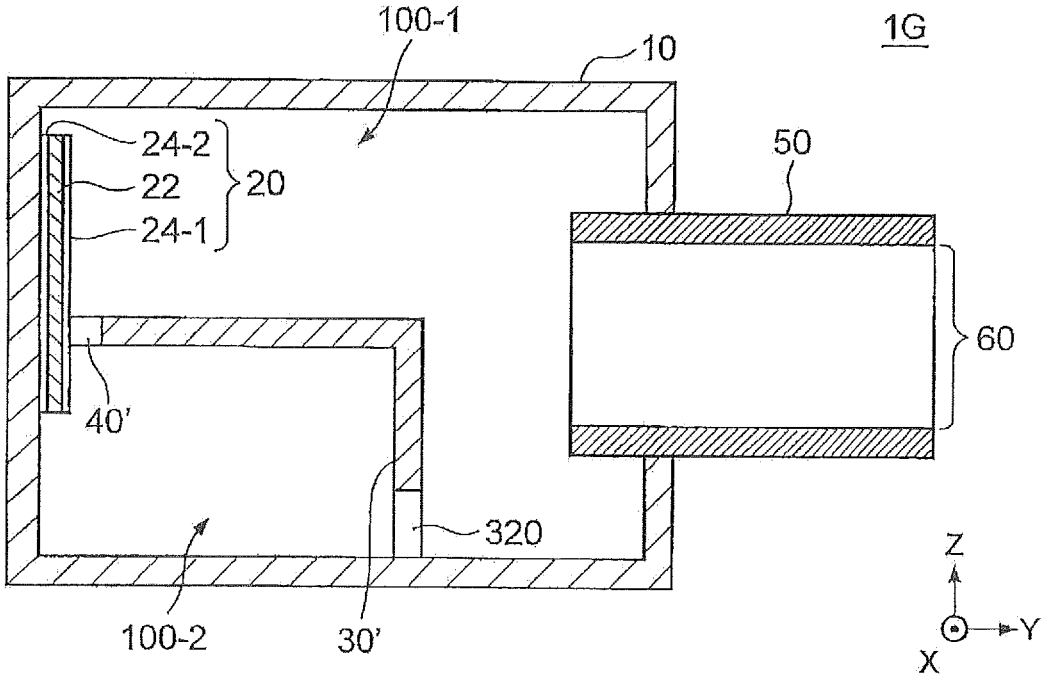
FIG. 9 is a cross-sectional view of an inventive earphone.

The earphone 1G illustrated in FIG. 9 differs from the earphone 1F in that the diaphragm 20 is disposed in the housing 10 so as to be shifted in the Z direction, such that a region of the diaphragm 20 facing the space 100-1 is larger than a region thereof facing the space 100-2. Like the earphone 1F, the earphone 1G of FIG. 9 enables the sound-quality adjustment in specific frequency ranges, achieves constant acoustic characteristics over a wide frequency range from low frequencies to high frequencies, and enjoys cost and size reductions.

Figure 10:
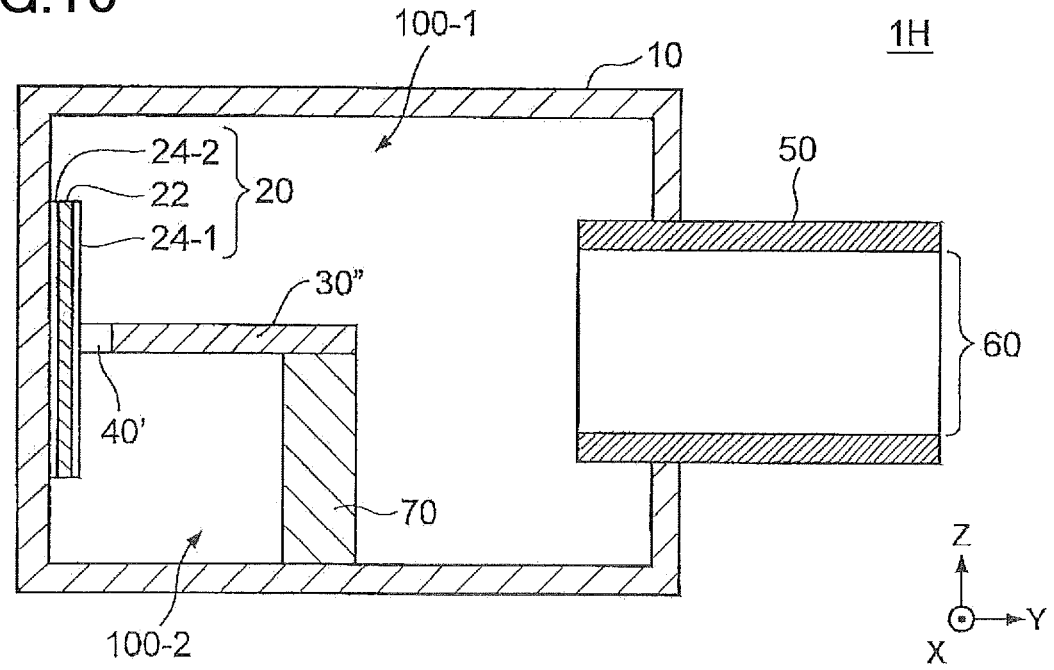
FIG. 10 is a cross-sectional view of an inventive earphone.
Figure 11:
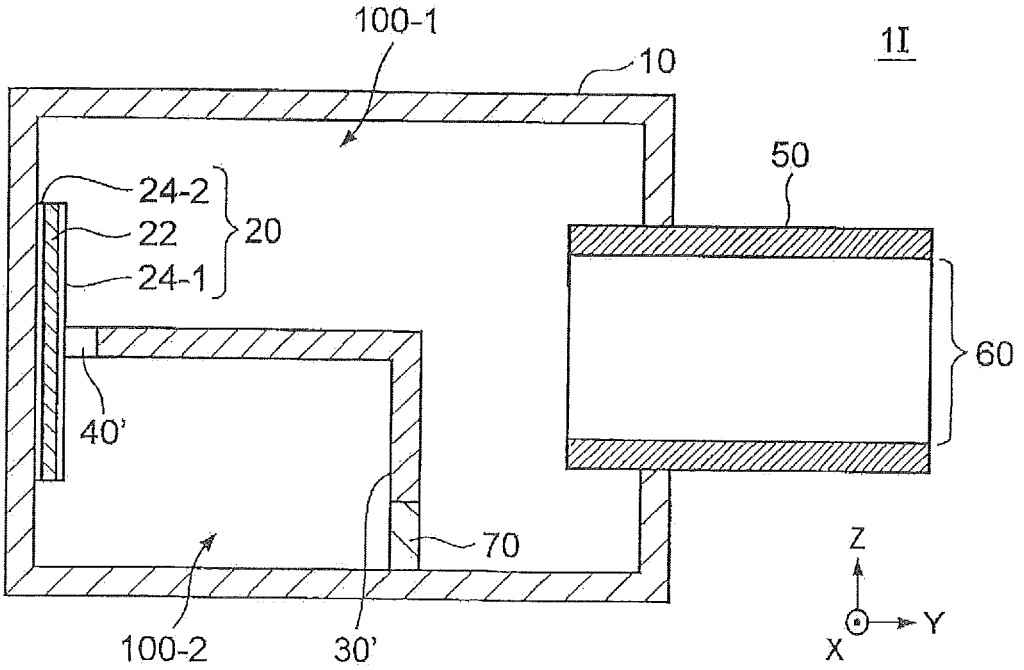
FIG. 11 is a cross-sectional view of an inventive earphone.

The earphone 1H illustrated in FIG. 10 differs from the earphone 1F in that the space 100-2 is defined by a partition wall 30" shaped like a plate and the sound absorber 70. The earphone 1I illustrated in FIG. 11 differs from the earphone 1F in that the space 100-2 is defined by the partition wall 30' and the sound absorber 70. The earphones 1H, 1I also enable the sound-quality adjustment in specific frequency ranges, achieve constant acoustic characteristics over a wide frequency range from low frequencies to high frequencies, and enjoy cost and size reductions.

While the embodiments have been described above, the embodiments may be modified as follows.

(1) In the embodiments illustrated above, the present disclosure is applied to the earphones. The electroacoustic transducer to which the present disclosure is applicable is not limited to the earphones but may be headphone speakers.

(2) The diaphragm in the previous embodiment is not limited to the piezoelectric element that includes the porous film formed of the piezoelectric material described above. The piezoelectric element may be a piezoelectric element in which lead zirconate titanate (PZT) or the like is used as the piezoelectric material, namely, a piezoelectric element capable of outputting from only one surface thereof. The diaphragm may be driven by a voice coil.

(3) In the previous embodiment, the inner space of the housing is divided into two spaces by one partition wall. The inner space of the housing may be divided into three or more spaces by two or more partition walls. That is, the electroacoustic transducer includes the housing, one or a plurality of partition walls that divide the inner space of the housing into a plurality of spaces such that at least one of the plurality of spaces has a volume different from a volume of at least one of others of the plurality of spaces except the at least one of the plurality of spaces, the diaphragm disposed in the housing such that one surface thereof faces the plurality of spaces, and a tube that establishes communication between the sound wave emission opening that is open to the outer space of the housing and the plurality of spaces. The sound quality can be adjusted in at least two different frequency ranges if at least one of the plurality of spaces has a volume different from those of other spaces.

Figure 12:
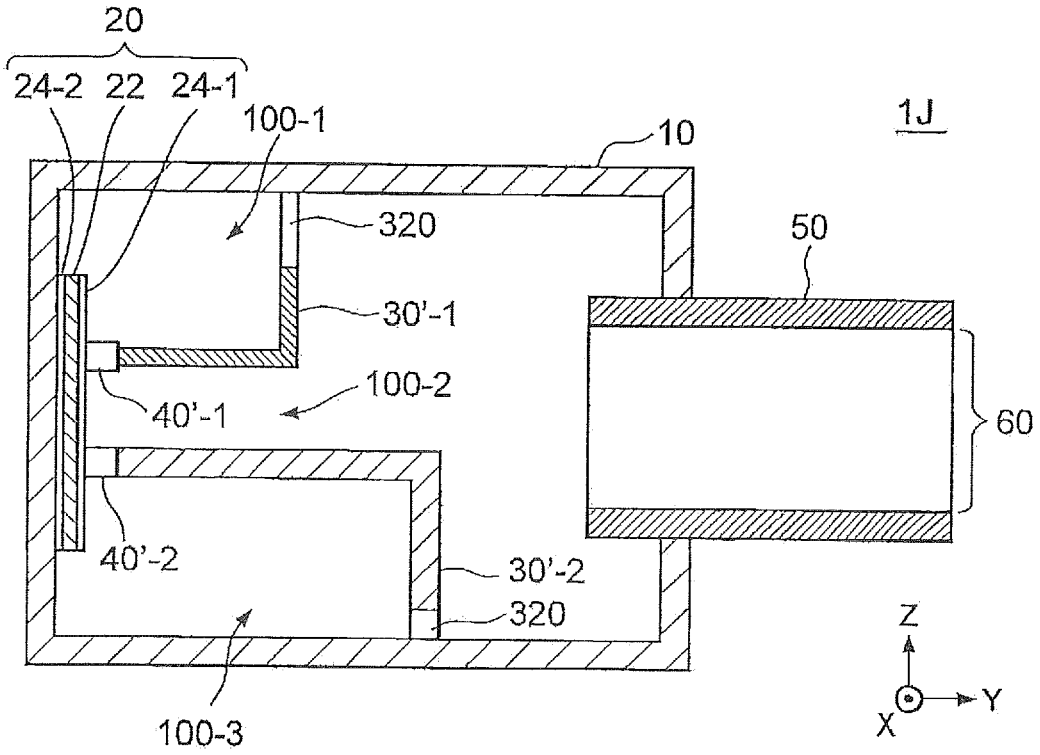
FIG. 12 is a cross-sectional view of an inventive earphone.

In an earphone 1J illustrated in FIG. 12, the space in the housing 10 is divided, by partition walls 30'-1, 30'-2, into three spaces, i.e., the space 100-1, the space 100-2, and the space 100-3 having mutually different volumes. An elastic member 40'-1 in FIG. 12 is a member filling a gap between the diaphragm 20 and one end of the partition wall 30'-1 without inhibiting the vibration of the diaphragm 20 in the thickness direction. An elastic member 40'-2 is a member filling a gap between the diaphragm 20 and one end of the partition wall 30'-2 without inhibiting the vibration of the diaphragm 20 in the thickness direction. In the earphone 1J illustrated in FIG. 12, the sound quality can be adjusted in three different frequency ranges by dividing the inner space of the housing 10 into the three spaces having mutually different volumes.

Figure 13:
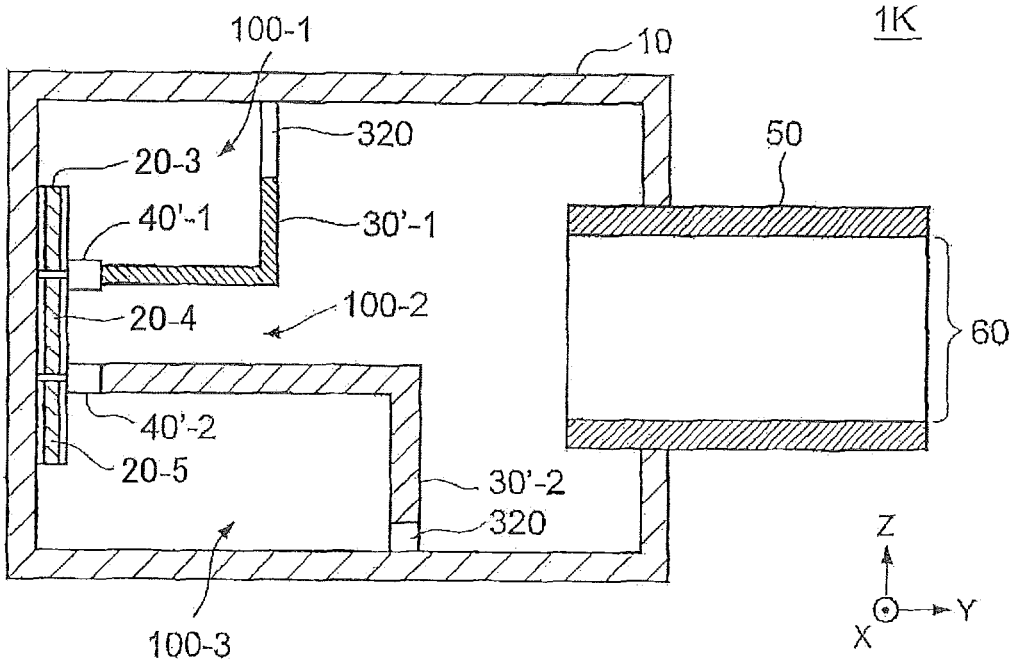
FIG. 13 is a cross-sectional view of an inventive earphone.

The diaphragm whose one surface faces the plurality of spaces is not limited to one diaphragm. That is, the earphone may include a plurality of diaphragms, as illustrated in FIG. 13. Specifically, an earphone 1K of FIG. 13 includes a diaphragm 20-3 as a diaphragm whose one surface faces the space 100-1, a diaphragm 20-4 as a diaphragm whose one surface faces the space 100-2, and a diaphragm 20-5 as a diaphragm whose one surface faces the space 100-3. In each of the diaphragm 20-3, the diaphragm 20-4, and the diaphragm 20-5, one of the two electrodes, which is provided on the other surface of the diaphragm attached to the inner wall surface of the housing 10, is grounded, and a voltage based on the sound signal is applied to the other of the two electrodes. In this configuration, the diaphragm 20-3, the diaphragm 20-4, and the diaphragm 20-5 respectively emit sound waves in the same phase. Similarly, in the earphones 1F-1I of FIGS. 8-11, the diaphragm facing the space 100-1 and the diaphragm facing the space 100-2 may be separate diaphragms.

(4) The earphones in the illustrated embodiments may be configured such that a ratio among the volumes of the plurality of spaces each serving as the cavity in the Helmholtz resonator and/or a ratio among the cross-sectional areas of the plurality of tubes each serving as the neck in the Helmholtz resonator may be variable. The thus configured earphone enables the user to finely adjust the sound quality in specific frequency ranges depending on the user's preferences or tastes.

Figure 14:
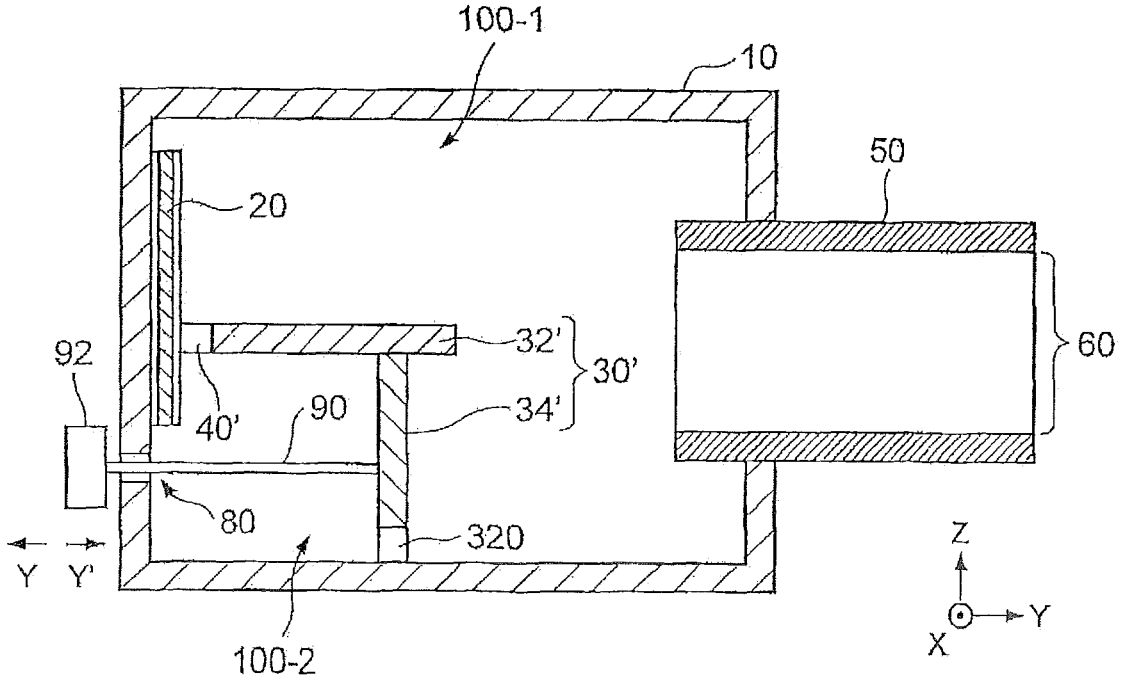
FIG. 14 is a cross-sectional view of an inventive earphone.

In the earphone 1A of the previous embodiment, for instance, by packing the sound absorber in one of the first tube 50-1 and the second tube 50-2 from an end portion of the tube 50 closer to the sound wave emission opening 60, the cross-sectional area of the one of the first tube 50-1 and the second tube 50-2 can be adjusted. For instance, the earphone 1F of the previous embodiment may be modified as illustrated in FIG. 14, such that the partition wall 30' is constituted by a plate-like first member 32' and a second member 34' provided so as to be perpendicular to the first member 32' and slidable in the Y direction in FIG. 14 and such that one end of a rod-like member 90 protruding outside the housing 10 through a through-hole 80 formed in the housing 10 is connected to the second member 34' and a knob 92 is attached to the other end of the rod-like member 90. In this configuration, the volume of the space 100-2 can be increased by pushing the knob 92 in a Y' direction or decreased by pulling the knob 92 in the Y direction. Likewise, in the earphone 1A of the previous embodiment, the volume of any one of the first space 110-1 and the second space 110-2 may be made variable. The second member 34 in FIG. 1 may be configured to be movable in the Z direction by providing the rod-like member 90 and the knob 92 in FIG. 14, thus enabling a ratio between the volume of the first space 110-1 and the volume of the second space 110-2 to be variable in the configuration of FIG. 1. Further, the third member 36 in FIG. 1 may be configured to be movable in the Z direction by providing the rod-like member 90 and the knob 92, thus enabling a ratio between the cross-sectional area of the first tube 50-1 and the cross-sectional area of the second tube 50-2 to be variable in the configuration of FIG. 1. Further, the rod-like member 90 and the knob 92 may be provided for each of the second member 34 and the third member 36, thus enabling both i) the ratio between the volume of the first space 110-1 and the volume of the second space 110-2 and ii) the ratio between the cross-sectional area of the first tube and the cross-sectional area of the second tube to be variable in the earphone 1A of FIG. 1.

What is claimed is:

1. An electroacoustic transducer, comprising:

a housing;

a piezoelectric element disposed in the housing and including a porous film and a pair of electrodes sandwiching the porous film therebetween;

a partition wall dividing an inner space of the housing into a first space closer to one of the pair of electrodes and a second space closer to another of the pair of electrodes;

a first tube that establishes communication between a sound wave emission opening that is open to an outer space of the housing and the first space; and a second tube that establishes communication between the sound wave emission opening and the second space.

2. The electroacoustic transducer according to claim 1, wherein the piezoelectric element divides, as a part of the partition wall, the inner space of the housing into the first space and the second space.

3. The electroacoustic transducer according to claim 1, wherein the one of the pair of electrodes is provided on one of opposite surfaces of the porous film and the another of the pair of electrodes is provided on another of the opposite surfaces of the porous film, and wherein the porous film expands or contracts in a thickness direction of the porous film in accordance with a sound signal externally applied to the one of the pair of the electrodes or the another of the pair of electrodes.

4. The electroacoustic transducer according to claim 1, wherein one of opposite surfaces of the piezoelectric element that is located on a side of the one of the pair of electrodes is exposed to the first space without being exposed to the second space while the another of the opposite surfaces of the piezoelectric element that is located on a side of the another of the pair of electrodes is exposed to the second space without being exposed to the first space.

5. The electroacoustic transducer according to claim 1, wherein the piezoelectric element is disposed on a same plane as the partition wall.

6. The electroacoustic transducer according to claim 1, wherein the piezoelectric element is attached to the partition wall via an elastic member.

7. The electroacoustic transducer according to claim 1, wherein a volume of the first space and a volume of the second space are identical.

8. The electroacoustic transducer according to claim 1, wherein a volume of the first space and a volume of the second space are different.

9. The electroacoustic transducer according to claim 1, wherein a cross-sectional area of the first tube and a cross-sectional area of the second tube are identical.

10. The electroacoustic transducer according to claim 1, wherein a cross-sectional area of the first tube and a cross-sectional area of the second tube are different.

11. The electroacoustic transducer according to claim 1, wherein a sound absorber is provided for at least one of i) the first tube, and ii) the second tube.

12. The electroacoustic transducer according to claim 1, wherein a ratio between a volume of the first space and a volume of the second space is variable.

13. The electroacoustic transducer according to claim 1, wherein a ratio between a cross-sectional area of the first tube and a cross-sectional area of the second tube is variable.

14. The electroacoustic transducer according to claim 1, wherein the ratio between the volume of the first space and the volume of the second tube and the ratio between the cross-sectional area of the first tube and the cross-sectional area of the second tube are variable.

* * * * *